US006561621B2

(12) United States Patent
Webster et al.

(10) Patent No.: US 6,561,621 B2
(45) Date of Patent: May 13, 2003

(54) VACUUM SPITTOON FOR COLLECTING INK DURING SERVICING OF INK JET PRINTHEADS

(75) Inventors: Grant A. Webster, Valley Center, CA (US); Jeffrey D. Rutland, San Diego, CA (US); John Murphy, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 48 days.

(21) Appl. No.: 09/872,947

(22) Filed: Jun. 1, 2001

(65) Prior Publication Data

US 2002/0180828 A1 Dec. 5, 2002

(51) Int. Cl.[7] ..... B41J 2/165
(52) U.S. Cl. ..... 347/34; 347/35; 347/36
(58) Field of Search ..... 347/34, 36, 22, 347/23, 29, 30, 32, 35

(56) References Cited

U.S. PATENT DOCUMENTS

| | | | | |
|---|---|---|---|---|
| 4,701,771 A | * | 10/1987 | Ikeda | 250/577 |
| 5,172,140 A | * | 12/1992 | Hirabayashi et al. | 347/23 |
| 5,296,873 A | * | 3/1994 | Russell et al. | 101/424.1 |
| 5,406,316 A | | 4/1995 | Schwiebert et al. | 347/18 |
| 5,428,384 A | | 6/1995 | Richtsmeier et al. | 347/102 |
| 5,563,639 A | | 10/1996 | Cameron et al. | 347/34 |
| 5,589,866 A | | 12/1996 | Russell et al. | 347/102 |
| 5,617,124 A | | 4/1997 | Taylor et al. | 347/35 |
| 5,742,303 A | | 4/1998 | Taylor et al. | 347/36 |
| 5,774,141 A | | 6/1998 | Cooper et al. | 347/34 |
| 6,082,848 A | | 7/2000 | Taylor | 347/35 |
| 6,203,137 B1 | * | 3/2001 | Niimura et al. | 347/100 |
| 6,375,304 B1 | * | 4/2002 | Aldrich et al. | 347/35 |

FOREIGN PATENT DOCUMENTS

| | | |
|---|---|---|
| EP | 0705699 | 4/1996 |
| EP | 1070591 | 1/2001 |
| JP | 4028560 | 1/1992 |
| WO | WO 01/60623 | 8/2001 |

OTHER PUBLICATIONS

British Search Report dated Jun. 19, 2002, Gary Williams, GB 0211253.0 claims 1–12.

* cited by examiner

*Primary Examiner*—Shih-wen Hsieh

(57) ABSTRACT

A collection spittoon with a vacuum connection draws air and ink ejected during service spitting through an opening in the top of the spittoon. The collected ink includes main ejected drops and aerosol generated during the service process. A method for servicing an inkjet printhead comprises positioning the printhead over an opening in a spittoon chamber, establishing an air flow into the chamber through the opening, actuating the printhead to spit ink droplets in a service mode, and collecting the ink droplets and associated aerosol by drawing the ink droplets and aerosol into the chamber with the air flow.

17 Claims, 2 Drawing Sheets

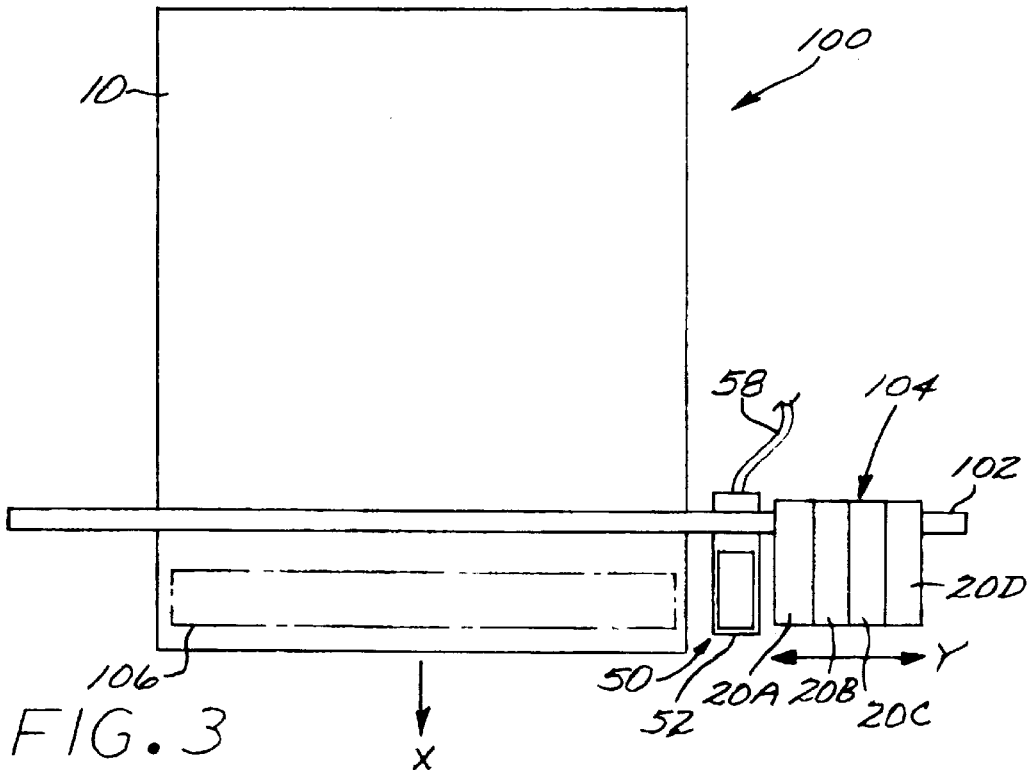
FIG. 3
FIG. 4
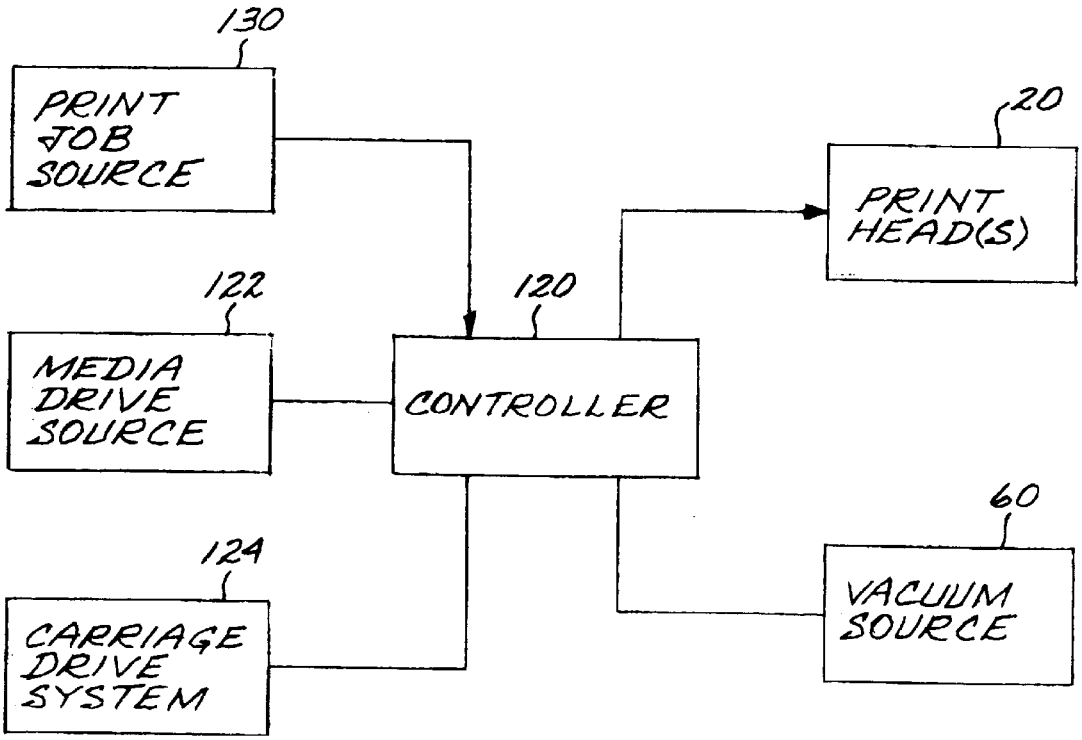

VACUUM SPITTOON FOR COLLECTING INK DURING SERVICING OF INK JET PRINTHEADS

TECHNICAL FIELD OF THE DISCLOSURE

The invention relates to servicing of ink jet printheads.

BACKGROUND OF THE DISCLOSURE

An inkjet printing mechanism is a type of non-impact printing device which forms characters and other images by controllably spraying drops of ink from a printhead. Inkjet printing mechanisms may be employed in a variety of devices, such as printers, plotters, scanners, facsimile machines, and the like. For convenience, inkjet printers are used herein to illustrate the concepts of the present invention.

The printhead ejects ink through multiple nozzles in the form of drops which travel across a small air gap and land on a recording media. The drops are very small. Inkjet printers commonly print within a range of 180 to 600 dots per inch (dpi) or even higher. The ink drops dry on the recording media shortly after deposition to form the desired printed images.

There are various types of inkjet printheads including, for example, thermal inkjet printheads and piezoelectric inkjet printheads. By way of example, for a thermal inkjet printhead, ink droplets are ejected from individual nozzles by localized heating. A small heating element is disposed at individual nozzles. An electrical current is passed through the element to heat it up. This causes a tiny volume of ink to be rapidly heated and ejected through the nozzle. A driver circuit is coupled to individual heating elements to provide the energy pulses and thereby controllably deposit ink drops from associated individual nozzles. Such drivers are responsive to character generators and other image forming circuitry to energize selected nozzles of the printhead for forming desired images on the recording media.

During start-up just prior to a printing cycle, it is common to maneuver the printhead to a service station and prepare the printhead by firing ink drops into a reservoir or spittoon. Sometimes hundreds, or even thousands, of ink drops are rapidly fired into the reservoir. This preliminary firing clears the nozzles and orifices of any ink build-up or debris in preparation for a more controllable ink deposition when the printhead is returned to the recording media. The printhead can return to the service station periodically while printing is in progress to re-clean the nozzles.

As the printhead is firing ink droplets into the spittoon, it releases undesired ink aerosol. Inkjet aerosol is small droplets of ink that are generated as a result of firing an inkjet printhead. These small droplets are often not deposited directly into the spittoon, but instead end up contaminating the printhead and the internal surfaces of the printing mechanism. The smaller the droplets, the more sensitive they are to outside influences such as air currents which aid in misdirecting the droplets away from the spittoon. Ink contamination causes additional undesired problems such as dirt build-up, high frictional forces on moving parts, and operator exposure to wet ink.

It is desirable to control the flow of inkjet aerosol in an effort to minimize the adverse effects of ink contamination. One solution to controlling inkjet aerosol is to provide an absorbent surface that is close to the printhead when firing. The aerosol impinges on this surface, and the liquid ink coalesces out of the air. This technique is not satisfactory, however, for inks that contain significant amounts of solids because the absorbent material can quickly clog. The accumulated solids continue to build up until they contaminate the printhead. The absorbent method also has limits for non-solid inks because a large volume of absorbent material must be provided to store the amount of ink discharged over the life of the printer. This makes the printer larger, more expensive, and imposes other restraints on the design.

Another technique which has been used is to spit ink onto a rotating wheel or onto absorbent foam. Spitting onto absorbent cloth causes a buildup of ejected liquid in the cloth, requiring a large volume of the cloth to be stored in the printer. The capillary transfer of ink in the cloth limits this to inks which will not form solid masses. Spitting into a container (disposable or permanent) causes a large space to exist promoting aerosol which cross contaminates the print heads with fluids from the other print heads. The service area of the printer becomes contaminated also. Spitting onto a rotating wheel requires either a wheel of large diameter, badly affecting the form factor of the printer, or allowing a large distance from some areas of the print head face to the wheel, promoting aerosol that cross contaminates the printheads and the printer. Spitting onto absorbent foam can cause a build up of ejected ink that can touch and contaminate the printheads as they pass over the spittoon.

SUMMARY OF THE DISCLOSURE

A method for servicing an inkjet printhead comprises positioning the printhead over an opening in a spittoon chamber, establishing an air flow into the chamber through the opening, actuating the printhead to spit ink droplets in a service mode, and collecting the ink droplets and associated aerosol by drawing the ink droplets and aerosol into the chamber with the air flow.

A service station for an inkjet printhead includes a spittoon container defining a spittoon chamber, the container having an opening. A vacuum source is fluidically coupled to a bottom or side of the spittoon chamber for establishing an air flow into the container opening during a printhead service mode.

BRIEF DESCRIPTION OF THE DRAWING

These and other features and advantages of the present invention will become more apparent from the following detailed description of an exemplary embodiment thereof, as illustrated in the accompanying drawings, in which:

FIG. 3 is a diagrammatic top view of elements of a printing system employing a service station as in FIG. 1.

FIG. 4 is a simplified schematic block diagram of elements of the printing system of FIG. 3.

DETAILED DESCRIPTION OF THE DISCLOSURE

Figure 1:
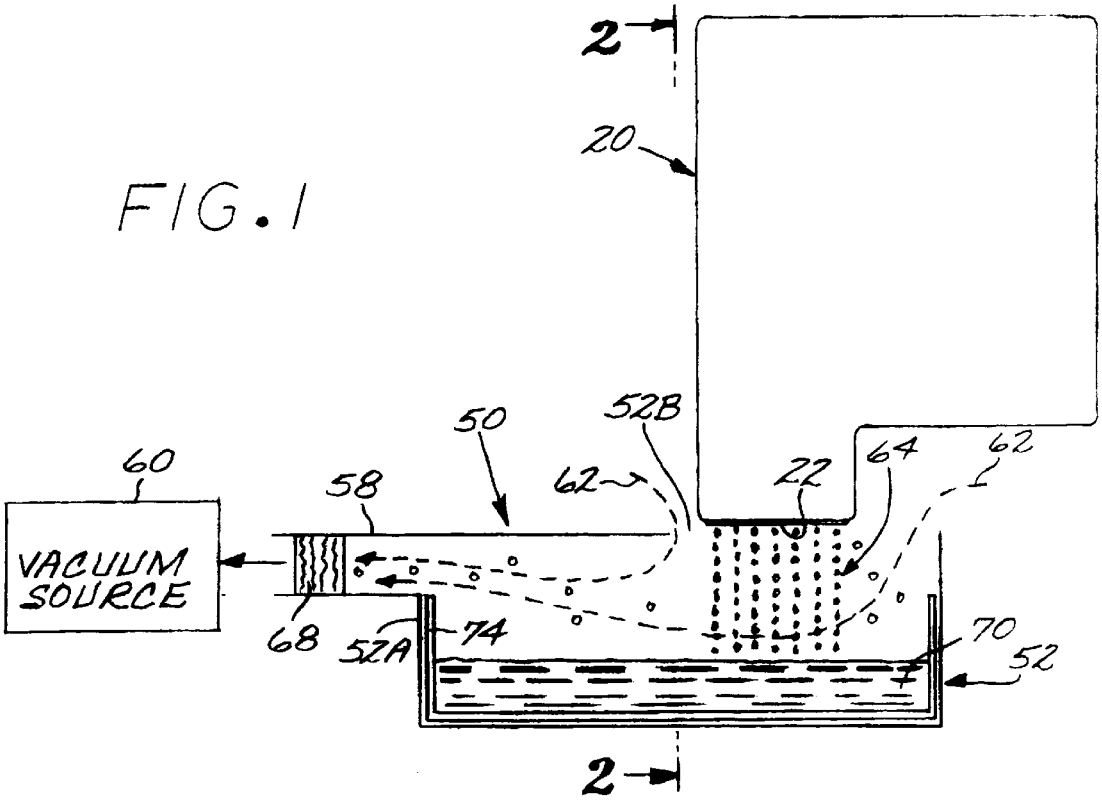
FIG. 1 is a simplified schematic diagram illustrating a service station embodying aspects of this invention.

FIG. 1 shows a printhead 20 positioned at a service station 50 of a printing system. The printhead is positioned over a spittoon container 52 defining a chamber 54. A vacuum line 58 is fluidically coupled to the chamber 54, e.g. through a side or to the bottom of the chamber 54, and to a vacuum source 60. For this exemplary embodiment, the line 58 is connected to the side 52A of the container 52. Exemplary sources of the vacuum can include a fan system for producing a vacuum, or, in the event a vacuum system is already employed by the printing system, such as a vacuum media hold-down system, a tap off this vacuum system. A filter 68 is positioned in the line 58.

When positioned at the service station as shown in FIG. 1, and with the vacuum source 60 activated and producing an airflow indicated by arrows 62 into the chamber 54, the printhead can be actuated to spit droplets of ink from its nozzle array 22. The resulting droplets of ink and aerosol, indicated generally by reference 64, are spit into the spittoon chamber 52, with the airflow 62 drawing the ink droplets and aerosol 64 into the opening 52B in the top of the container 52. The droplets and aerosol are collected in the bottom of the container 52, as illustrated by the material indicated as body 70. Filter 68 traps any ink droplets aerosol 64 which are drawn into the vacuum line 58, preventing this portion of the material 64 which enters the line from being exhausted from the line 58 to the vacuum source 60 or into the printer environment.

The air flow velocity at the entrance opening 52B to the spittoon is sufficiently high to entrain the ejected drops and aerosol. In one exemplary embodiment, air velocities in the range of about 50 to 110 linear feet per minute are sufficient for the purpose. The minimum air flow velocity for a given application will depend on factors including the separation and spacing distances between the edges of the spittoon opening and the face of the printhead.

For aqueous inks, the ink spit into the spittoon dries out with time, leaving behind the solids that are dissolved in the ink. These solids pose little risk of being pulled into the vacuum line 58. For non-aqueous inks, the liquid ink would not be pulled into the line 58 until the level of body 70 rose above some dimension determined in the design of the spittoon, e.g. the level of the entrance to line 58 in the spittoon side wall 52A. At that point, the spittoon is preferable replaced or serviced.

In one exemplary embodiment, the spittoon entrance opening is 2.8 cm wide by 3.5 cm long for a printhead face (carrying the nozzle array) 1.3 cm wide by 2.6 cm long. The face 20A (FIG. 2) of the printhead for this embodiment is positioned a distance D1 above the spittoon opening of about 2 mm during a service operation. The required dimensions for successful operation for a given application depend on the separation distances between the printhead face and the spittoon opening surfaces, as well as the air flow rates. Larger separation distances will tend to use higher air flow rates to achieve the desired droplet entraining effect.

Figure 2:
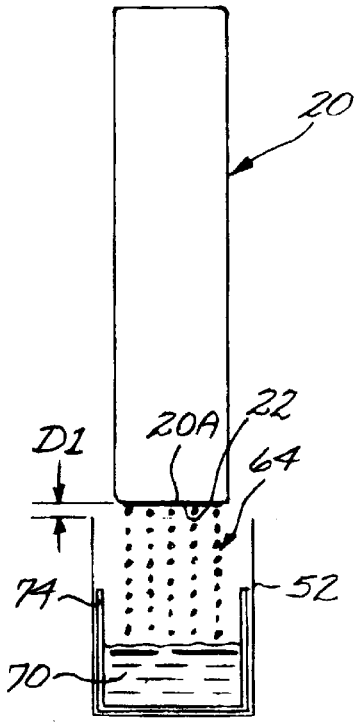
FIG. 2 is a cross-sectional view of the service station taken along line 2—2 of FIG. 1.

The spittoon container 52 is sufficiently deep that the body 70 of ink or other material accumulated in it does not build up and touch the printheads. The dimensions of the spittoon container are typically determined by the maximum volume of ink and other debris to be accumulated, characteristics of the printer in which the spittoon container is employed, the type of ink (e.g., aqueous or non-aqueous ink), and the replacement strategy for the spittoon. Examples of replacement strategies include that the volume of the spittoon container is calculated to last the life of the printer, that the spittoon is user replaceable on a regular basis, that the spittoon is technician replaceable, and replaced when the customer requests a service call, and that the spittoon container includes a replaceable liner that contains the waste ink, which could be supplied with each new ink cartridge. Such a liner is shown in FIGS. 1–2 as liner structure 74. The liner can be formed of a thin layer of plastic, cardboard or other material, such as an absorbent material or even a flexible bag-like member. In an exemplary embodiment, the liner fits into the interior volume of the container, and can be lifted out of the spittoon container through the opening 52A, or by removal of a spittoon top cover defining the opening size, for replacement with a fresh liner or to empty the liner structure of accumulated debris.

An exemplary application for the service station 50 is illustrated in the diagrammatic top view of FIG. 3, showing a swath-type ink jet printing system 100. FIG. 4 is a simplified schematic block diagram illustrating control elements of the printing system 100. A controller 120 such as a microcomputer or ASIC receives print job commands and data from a print job source 130, which can be a personal computer, digital camera or other source of print jobs. The controller acts on the received commands to activate the media drive system 122 to advance the print medium 10 along a media path in an X axis to advance the print medium to the print zone 106. The carriage drive system 124 is activated by the controller to position the carriage holding the printhead(s) 20 for commencement of a print job, and to scan the carriage in a Y axis transverse to the media path. Firing pulses are sent to the printhead(s) 20. The controller is programmed to advance incrementally the print medium 10 using the media drive system 122 and the belt 58 to position the medium for successive swaths, and to eject the completed print medium into an output tray. A slider bar structure 102 supports a printhead carriage 104 for traversing movement in the Y axis, to provide printhead coverage of the print zone 106. The print medium 10 such as paper or other type of media is moved along a media path to position the medium 10 at the print zone 10 during printing operations. In this embodiment, the carriage 104 holds four print cartridges 20A–20D, and each can hold a different color of ink, e.g. black, yellow, cyan and magenta. This is of course only one exemplary type of printing system which can employ the service station 50 in accordance with the invention.

The service station 50 is positioned along a path of travel of the carriage, to one side of the print zone. The carriage 104 has sufficient range of movement to position any of the printheads over the spittoon container 52. To perform a printhead service procedure using the service station 50, the carriage is driven along the slider rod structure 102 to position one of the printheads over the opening for the spittoon container. The controller 120 activates the vacuum source 60, in the case where the vacuum source is dedicated to the vacuum spittoon function. If the vacuum is taken off a source of vacuum used for another function, e.g. to hold the print medium against a perforated platen surface, then the vacuum will already be applied to the spittoon. The positioned printhead is then activated to spit droplets of ink into the spittoon. The process can be repeated for each of the remaining printheads, by moving the remaining printheads one by one in position over the spittoon and activating the printhead nozzles or drop generators.

In an alternative embodiment, separate spittoons can be provided for each printhead, and the spitting service routine for all the printheads performed simultaneously.

A vacuum spittoon has been disclosed, which provides an improved technique for controlling contamination than previous collection schemes for capturing ink and aerosol generated during service spitting. The vacuum spittoon provides a convenient way of collecting for disposal the waste fluid generated during servicing.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for servicing an inkjet printhead, comprising:

positioning the printhead over an opening in a spittoon chamber at a printhead service station;

establishing an air flow into the chamber through the opening, including drawing air from the opening and into a vacuum line attached to the chamber at a side or a bottom of the chamber;

actuating the printhead to spit ink droplets in a service mode;

collecting the ink droplets and associated aerosol in the spittoon chamber by drawing the ink droplets and aerosol into the chamber with the air flow.

2. The method of claim 1 wherein said step of establishing the air flow includes attaching a distal end of the vacuum line to a source of vacuum.

3. The method of claim 1 further comprising: servicing the spittoon chamber after a quantity of debris resulting from the collected droplets and associated aerosol has collected in the spittoon chamber.

4. The method of claim 2 wherein said servicing the spittoon chamber includes:

replacing the spittoon chamber with a fresh chamber.

5. The method of claim 4 wherein:

said collecting the ink droplets and associated aerosol in the spittoon chamber includes collecting the ink droplets and associated aerosol on a replaceable liner in said spittoon chamber, and wherein said servicing the spittoon chamber includes replacing the liner with a fresh liner.

6. The method of claim 4 wherein said servicing the spittoon chamber includes removing the quantity of debris from the spittoon chamber.

7. The method of claim 1, wherein said establishing an air flow into the chamber includes establishing an air flow having an air velocity in the range of about 50 to 110 linear feet per minute.

8. A method for servicing an inkjet printhead, comprising:

mounting the printhead in a carriage for traversing movement along a swath axis through a range of movement over a print zone;

positioning a service station adjacent the print zone, the service station including a spittoon chamber having an opening;

in a service mode, moving the carriage along the range of movement to position the printhead over the spittoon opening at the service station;

actively establishing an air flow into the chamber through the opening, including drawing air from the opening and into a vacuum line attached to the chamber at a side or a bottom of the chamber;

actuating the printhead to spit ink droplets toward the opening;

collecting the ink droplets and associated aerosol in the spittoon chamber by drawing the ink droplets and aerosol into the chamber with the air flow.

9. The method of claim 8 wherein said step of establishing the air flow includes attaching a distal end of the vacuum line to a source of vacuum.

10. The method of claim 8 further comprising:

servicing the spittoon chamber after a quantity of debris resulting from the collected droplets and associated aerosol has collected in the spittoon chamber.

11. The method of claim 9 wherein said servicing the spittoon chamber includes:

replacing the spittoon chamber with a fresh chamber.

12. The method of claim 11 wherein:

said collecting the ink droplets and associated aerosol in the spittoon chamber includes collecting the ink droplets and associated aerosol on a replaceable liner in said spittoon chamber, and wherein said servicing the spittoon chamber includes replacing the liner with a fresh liner.

13. The method of claim 11 wherein said servicing the spittoon chamber includes removing the quantity of debris from the spittoon chamber.

14. The method of claim 8, wherein said establishing an air flow into the chamber includes establishing an air flow having an air velocity in the range of about 50 to 110 linear feet per minute.

15. A service station for an inkjet printhead, comprising:

a spittoon container mounted adjacent a print zone and positioned relative to a printhead range of movement such that the printhead can be positioned over a spittoon container opening during a service mode, the spittoon including a spittoon chamber;

a vacuum source fluidically coupled to a bottom or side of the spittoon chamber for establishing an air flow into the container opening during a printhead service mode to draw the ink droplets and aerosol into the chamber with the air flow, the spittoon chamber collecting the ink droplets and associated aerosol in the spittoon chamber.

16. The service station of claim 14, further comprising a tube having a first end connected to an opening in the bottom or side of the chamber and a second end connected to said vacuum source.

17. A printing system, comprising:

a printhead;

a carriage holding the printhead, the carriage mounted for traversing movement along a swath axis through a range of movement over a print zone;

a carriage drive system for driving the carriage along the swath axis;

a media drive system for moving a print media along a media path to the print zone;

a service station positioned adjacent the print zone, the service station including a spittoon chamber having an opening, the spittoon opening positioned so that the printhead can be positioned over the spittoon opening by moving the carriage away from the print zone during a service mode;

a system for actively establishing an air flow into the spittoon chamber through the opening during the service mode when the printhead is activated to spit ink droplets toward the opening to drawing ink droplets and associated aerosol into the spittoon chamber with the air flow, the system including a vacuum source fluidically coupled to a bottom or side of the spittoon chamber;

the spittoon chamber for collecting the ink droplets and associated aerosol in the spittoon chamber.

* * * * *